US007270238B2

(12) United States Patent
Shannon

(10) Patent No.: US 7,270,238 B2
(45) Date of Patent: Sep. 18, 2007

(54) VACUUM SEALABLE BAG APPARATUS AND METHOD

(75) Inventor: Daniel P. Shannon, Green Bay, WI (US)

(73) Assignee: FoodFresh Technologies, LLC, Wausau, WI (US)

( * ) Notice: Subject to any disclaimer, the term of this patent is extended or adjusted under 35 U.S.C. 154(b) by 464 days.

(21) Appl. No.: 10/782,536

(22) Filed: Feb. 19, 2004

(65) Prior Publication Data

US 2004/0231294 A1 Nov. 25, 2004

Related U.S. Application Data

(63) Continuation-in-part of application No. 10/124,589, filed on Apr. 17, 2002, now Pat. No. 6,991,109.

(60) Provisional application No. 60/284,690, filed on Apr. 17, 2001, provisional application No. 60/448,244, filed on Feb. 19, 2003.

(51) Int. Cl.
*B65D 81/20* (2006.01)

(52) U.S. Cl. ..... 206/524.8; 206/484; 383/94; 383/117

(58) Field of Classification Search ..... 206/484, 206/522, 524.8; 383/93, 94, 113, 117
See application file for complete search history.

(56) References Cited

U.S. PATENT DOCUMENTS

| | | | |
|---|---|---|---|
| 2,672,268 | A | 3/1954 | Bower |
| 2,714,557 | A | 8/1955 | Mahaffy |
| 2,778,171 | A | 1/1957 | Taunton |
| 2,778,173 | A | 1/1957 | Taunton |
| 3,170,619 | A | 2/1965 | Repko |
| 3,796,020 | A | 3/1974 | Anderson et al. |
| 3,866,390 | A | 2/1975 | Moreland, II et al. |
| 4,251,976 | A | 2/1981 | Zanni |
| 4,513,015 | A | 4/1985 | Clough |
| 4,576,283 | A | 3/1986 | Fafournoux |
| 4,683,702 | A | 8/1987 | Vis |
| 4,744,199 | A | 5/1988 | Gannon |
| 4,756,422 | A | 7/1988 | Kristen |
| 4,928,829 | A | 5/1990 | Di Bernardo |
| 4,941,310 | A | 7/1990 | Kristen |
| 5,048,269 | A | 9/1991 | Deni |
| 5,056,930 | A | 10/1991 | Mestetsky |
| 5,108,194 | A | 4/1992 | Raden |
| 5,215,445 | A | 6/1993 | Chen |
| 5,287,680 | A | 2/1994 | Lau |
| RE34,929 | E | 5/1995 | Kristen |

(Continued)

OTHER PUBLICATIONS

Website pages "Tredegar Film Products"; www.tredegarfilm.com; Apr. 9, 2002.

*Primary Examiner*—Mickey Yu
*Assistant Examiner*—Jerrold Johnson
(74) *Attorney, Agent, or Firm*—Michael Best & Friedrich

(57) ABSTRACT

Some embodiments of the present invention provide a vacuum sealable storage bag and method in which a pad of material is located within the storage bag and is positioned to block, trap, and/or absorb fluid from product to be stored within the storage bag. The pad of material can comprise fluid-absorbing material, and in some embodiments is positioned between an open mouth of the bag and an interior of the bag in which product is retained.

20 Claims, 6 Drawing Sheets

U.S. PATENT DOCUMENTS

| | | | |
|---|---|---|---|
| 5,549,944 | A | 8/1996 | Abate |
| 5,554,423 | A | 9/1996 | Abate |
| 5,784,862 | A | 7/1998 | Germano |
| 5,839,582 | A | 11/1998 | Strong et al. |
| 5,873,217 | A | 2/1999 | Smith |
| 5,893,822 | A | 4/1999 | Deni et al. |
| 5,894,929 | A | 4/1999 | Kai et al. |
| 6,012,844 | A | 1/2000 | Huseman et al. |
| 6,070,397 | A | 6/2000 | Bachhuber |
| 6,244,748 | B1 | 6/2001 | Kasai et al. |
| 6,378,272 | B1 | 4/2002 | Archibald et al. |
| 6,403,174 | B1 | 6/2002 | Copeta |
| 6,550,223 | B2 | 4/2003 | Xiong et al. |
| 2001/0034999 | A1 | 11/2001 | Xiong et al. |
| 2003/0024847 | A1 | 2/2003 | Malaspina |
| 2003/0102245 | A1 | 6/2003 | Wang |
| 2003/0155269 | A1 | 8/2003 | Lee |
| 2003/0219177 | A1 | 11/2003 | Salvaro |
| 2003/0234202 | A1 | 12/2003 | Anderson |
| 2004/0007494 | A1 | 1/2004 | Popeil et al. |

VACUUM SEALABLE BAG APPARATUS AND METHOD

RELATED APPLICATIONS

This is a continuation-in-part of U.S. patent application Ser. No. 10/124,589 filed on Apr. 17, 2002 now U.S. Pat. No. 6,991,109, which claims the benefit of prior filed U.S. provisional patent application Ser. No. 60/284,690 filed on Apr. 17, 2001, both of which are incorporated herein by reference. Priority is also hereby claimed to U.S. provisional patent application Ser. No. 60/448,244 filed on Feb. 19, 2003, which is also incorporated herein by reference.

FIELD OF THE INVENTION

This invention relates generally to storage bags, and more particularly to vacuum sealed storage bags.

BACKGROUND OF THE INVENTION

Vacuum sealable bags are popular for purposes of packaging and storing all types of objects and matter. Typically, vacuum sealable bags include two opposing sheets of plastic material, each sheet having an inner layer of heat-sealable material such as polyethylene, and an outer layer of a material resistant to gas permeation (known in the food storage bag and in other storage bag industries as "high barrier" material) such as nylon or polyester. The inner layer of vacuum sealable bags are often shaped to assist in evacuating such bags. For example, some vacuum-sealable bags having embossed or ribbed inner layers defining air channels extending to the mouth of the bag. These channels provide passages for air to exit the bag when placed under vacuum by a vacuum sealing apparatus. An increased thickness of the plastic sheets (e.g., the inner layer of a two-layer bag as described above) is often required to keep the channels open while the bag is under vacuum. An alternative is to use an intermediate reinforcing layer of plastic, such as a reinforcing layer between a heat sealable layer and a high barrier material layer (referred to above) of a two-layer bag.

Vacuum sealable bags are often sold in rolls. In many cases, the roll consists of a continuous tube of sheet material which is cut to a desired length and can be heat seal on an open end of the tube to form a bag.

Vacuum sealable bags that are shaped to better facilitate evacuation as described above are typically much more expensive than equivalent, non-vacuum sealable bags because of the increased material costs and special manufacturing processes needed to create such bags. As a result, the consumer may decide against purchasing vacuum sealable bags or abandon vacuum sealing altogether. Also, due to the increased thickness of the plastic material used in some conventional vacuum sealable bags that are heat-sealed, increased sealing times can be required to melt the heat sealable layers. Many conventional vacuum sealers utilize a heating wire with a fixed sealing time to melt the heat sealable layers. This fixed sealing time may not always be appropriate for different types of vacuum sealable bags. Insufficient sealing times may then lead to a leaking vacuum seal.

Fully evacuating the bags is also difficult to accomplish both with a conventional bag and a vacuum sealable bag. With a conventional bag, embossed or ribbed inner layers to provide air channels are non-existent. Typically, isolated pockets of trapped air are often left in the conventional bag upon sealing. This results when pockets of air no longer have an exit channel from the bag upon sealing. This is also a problem with some vacuum sealable bags. It is not uncommon for either embossed or ribbed walls of a vacuum sealable bag to collapse before complete evacuation has occurred, thereby trapping isolated pockets of air within the bag upon sealing.

In light of the problems and limitations of the prior art described above, a need exists for a vacuum-sealable bag apparatus and method in which improved storage bag evacuation is enabled, bags of different types can be evacuated, more reliable bag seals are produced, and the cost of vacuum sealing is reduced. Each preferred embodiment of the present invention achieves one or more of these results.

SUMMARY OF THE INVENTION

In some embodiments of the present invention, a strip of material is employed to assist in evacuating a storage bag. This venting strip can be made of a number of different materials, and in some embodiments is made of heat-sealable material (e.g., polyethylene) in order to bond with the plastic material of the bag when the bag is heat sealed. Other heat sealable materials such as polypropylene, wax adhesive on a substrate, wax paper, or hot melt adhesive on a foil or other substrate can instead be used to manufacture the venting strip. The strip of material can be inserted by a user into the storage bag prior to evacuating the bag, or can be provided already secured within the bag. Although the strip of material can be used in vacuum sealing any type of plastic bag, in some preferred embodiments, the strip of material is used in vacuum sealing storage bags having one or more heat sealable inner layers and one or more high barrier outer layers resistant to gas permeation.

In some highly preferred embodiments, the venting strip employed to assist in the vacuum sealing process is manufactured from an apertured strip (e.g., an apertured film or other sheet of material). When preparing a storage bag for sealing, the apertured strip creates small channels between the inside surface of the storage bag and the strip, thereby allowing air to exit from the interior of the storage bag. In those embodiments of the present invention in which the strip is made at least partially of heat-sealable material, the apertured strip can also melt with the heat sealable inner layers of the storage bag when a vacuum sealer applies heat to seal the storage bag.

The strip of material can take a number of different forms, including without limitation a corrugated sheet, a woven, non-woven, or extruded fabric or mesh, a strip having a dimpled, ribbed, or other varying cross-sectional shape, and the like. In some embodiments, the venting strip is sealed with at least one edge of the storage bag. An example includes a venting strip that is integrally sealed with the bottom edge of the storage bag. As another example, the venting strip can be sealed with a side edge of the storage bag. Multiple venting strips can also be employed, such as a venting strip sealed on each side edge of the storage bag. The venting strip preferably extends from an interior portion of the bag to the opening or mouth of the bag, and can extend the entire length of the bag if desired.

The venting strip can also or instead be tack welded (e.g., heat staked) at any point along its length and at any location within the storage bag. For example, one end of the venting strip can be secured to an interior wall of the storage bag adjacent to the mouth of the storage bag. Securing the venting strip in any of the manners described above will help maintain the venting strip's position in the storage bag while the storage bag is being loaded.

Some embodiments of the present invention provide a method of vacuum sealing a storage bag having an open end, wherein the method comprises positioning an item to be stored within the storage bag; inserting a pad of fluid-absorbing material at least partially within the storage bag; drawing air within the storage bag past the pad of fluid-absorbing material and through the open end of the storage bag; trapping fluid from the stored item in the pad of fluid-absorbing material as air is drawn past the pad of fluid-absorbing material; and sealing the open end of the storage bag.

Also, some embodiments of the present invention provide a method of manufacturing a storage bag having first and second sheets of plastic material, wherein the method comprises positioning pads of fluid-absorbing material at spaced intervals along the first and second sheets of plastic material between the first and second sheets of plastic material; sealing opposite edges of the first and second sheets of plastic material to create a continuous tube of plastic material; and coupling the pads of fluid-absorbing material to at least one of the first and second sheets of plastic material.

In some embodiments of the present invention, a vacuum sealable storage bag assembly is provided, and comprises a plastic bag comprising a first panel defining opposite side edges and opposite end edges, and a second panel defining opposite side edges and opposite end edges, wherein the opposite side edges of the second panel are coupled to the respective opposite side edges of the first panel, wherein one of the opposite ends of the second panel is coupled to an adjacent end of the first panel, and wherein a bag opening is defined at another of the opposite ends of the second panel; and a pad of fluid-absorbing material positioned within the plastic bag adjacent the bag opening, wherein the pad of fluid-absorbing material is located between a product-holding portion of the bag and the bag opening to absorb fluid drawn toward the bag opening during vacuum sealing operations, and wherein the pad of fluid-absorbing material is coupled to at least one of the first and second panels.

Some embodiments of the present invention provide tubestock bag material comprising a first sheet of plastic; a second sheet of plastic in facing relationship with the first sheet of plastic and coupled to the first sheet of plastic along opposite edges of the first and second sheets of plastic to define an interior of the tubestock bag material; and a pad of fluid-absorbing material coupled to at least one of the first and second sheets of plastic and located between the first and second sheets of plastic.

Further objects and advantages of the present invention, together with the organization and manner of operation thereof, will become apparent from the following detailed description of the invention when taken in conjunction with the accompanying drawings, wherein like elements have like numerals throughout the drawings.

BRIEF DESCRIPTION OF THE DRAWINGS

The present invention is further described with reference to the accompanying drawings, which show preferred embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

DETAILED DESCRIPTION

Figure 1A:
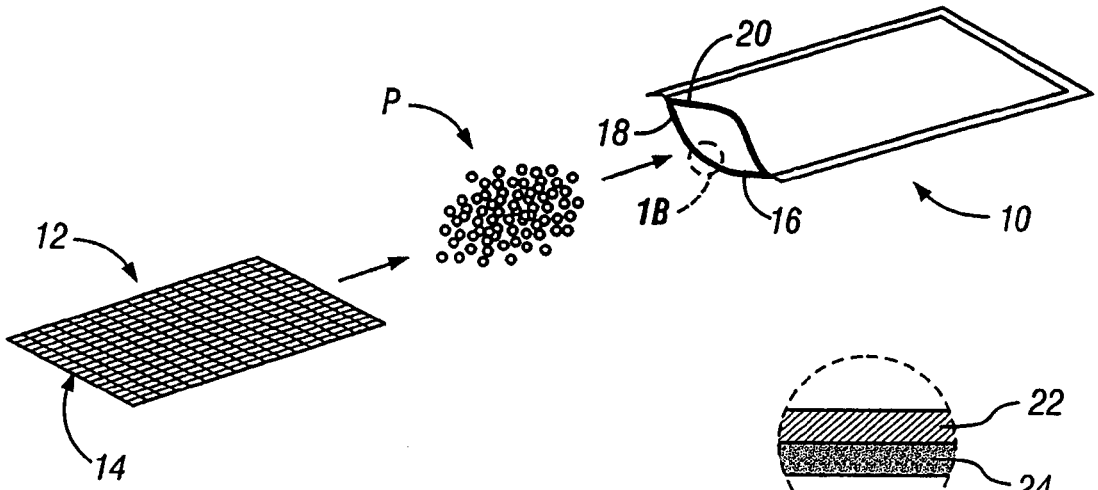
FIG. 1*a* is a front perspective view of a vacuum sealable bag with an insertable venting strip.
Figure 1B:
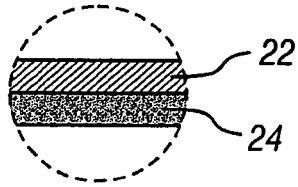
FIG. 1*b* is an enlarged partial view of the vacuum sealable bag as shown in FIG. 1*a;*

With reference first to FIG. 1*a*, a vacuum sealable bag 10 is shown with an unattached venting strip 12. The unattached venting strip 12 can be inserted within the bag 10 prior to, after, or during insertion of product P to be stored within the bag 10. Preferably, the unattached venting strip 12 is placed within the bag 10 such that an end 14 of the strip 12 extends to a point flush with the bag edges defining the mouth or open end 16 of the bag 10, although the venting strip 12 can instead extend outside of the open end 16 of the bag 10 or can be slightly recessed from the open end 16 of the bag 10. The bag 10 includes two pieces or "panels" of sheet material 18, 20 that are sealed together along the side and bottom edges of the bag 10. In the illustrated preferred embodiment shown in FIG. 1*b*, each piece of sheet material 18, 20 consists of a heat sealable inner layer 22 and a high barrier material outer layer 24 resistant to gas permeation as is best shown in FIG. 1*b*. The inner layer 22 preferably consists of polyethylene, but can instead be of any other type of heat sealable thermoplastic (e.g., polypropylene, ethylene-vinyl acetate, and the like). The outer layer 24 preferably consists of nylon, but can instead be of any other type of gas impermeable or high barrier plastic (e.g., polyester, polyvinyl chloride, and the like).

Although one or more heat sealable layers 22 are preferred, some bags used in accordance with the present invention do not have a heat sealable layer or do not have any heat sealable material at all for purposes of constructing or sealing the bag 10. Also, depending at least partially upon the product sealed and the desired length of storage, a high barrier layer or a gas impermeable layer (e.g., one or more outer layers) may not be required. In some cases employing heat sealing for constructing or vacuum sealing the bag 10, only a relatively thin, heat sealable layer is needed for each panel 18, 20. As indicated above, a heat sealable panel 18, 20 or layer 22 may not be required if some other form of sealing is used during the vacuum sealing process. For example, if other adhesive or cohesive bonding material is used to seal the bags 10, then only one layer of high barrier plastic can be used. Finally, it should be noted that some bags do not have identifiable "panels". Such bags can still be used with the venting strips 12 of the present invention in a manner as will be described in greater detail below. Accordingly, the terms "panels" and "sheets" as used herein and in the appended claims are intended to encompass parts of a bag 10 constructed in any manner.

The venting strip 12 can be made of any material desired, and in some preferred embodiments consists of or includes a heat sealable material. The heat sealable material (if used) of the venting strip 12 can be the same or different from a heat sealable layer 22 of the bag panels 18, 20. In this regard, the venting strip 12 can be made of or include polyethylene or polypropylene, can include wax or hot melt adhesive on a substrate such as paper, fabric, plastic, and the like, or can be made partially or entirely of any other heat sealable material. The venting strip 12 can also be made in a variety of shapes. Although elongated venting strip shapes are preferred, venting strips 12 can be found in rectangular, circular, elliptical, triangular, or any other shape desired. In addition, the bags 10 employed in the present invention can be in any shape desired.

Figure 2:
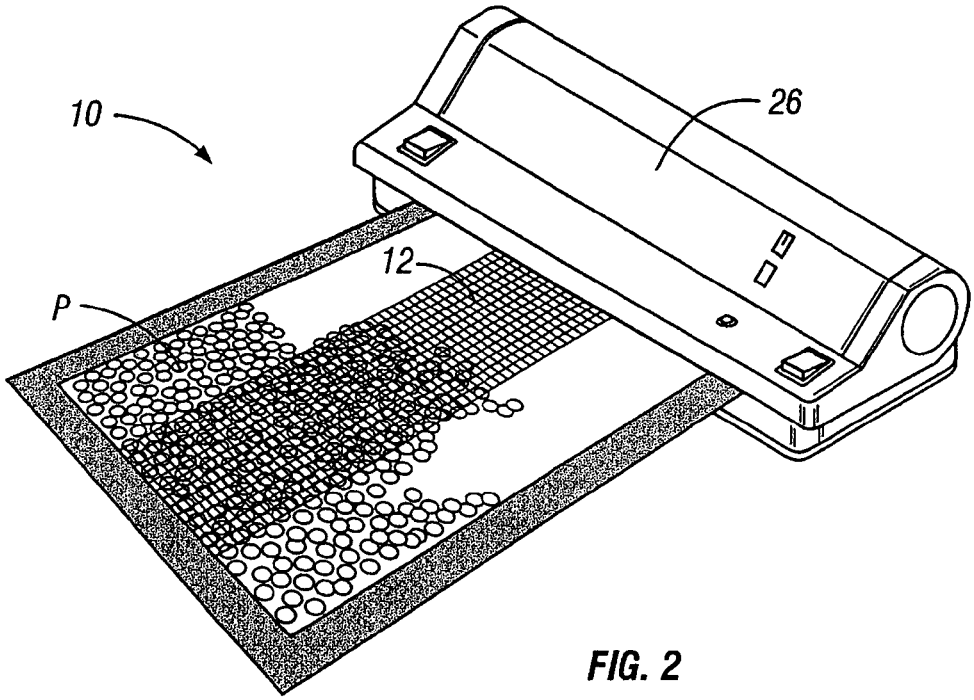
FIG. 2 is a front perspective view of a conventional vacuum sealing apparatus, shown with the vacuum sealable bag illustrated in FIG. 1.

The bag 10 can be evacuated and sealed in any conventional manner, dependent at least partially upon the bag material and the material employed to seal the bag 10. By way of example only, the heat-sealable bag 10 illustrated in the figures can be sealed by application of heat to the open end of the bag 10 in any manner, such as by a conventional vacuum sealer 26 shown in FIG. 2. In this embodiment, the bag 10 with the venting strip 12 received therein is inserted into the vacuum sealer 26. The sealer 26 preferably utilizes jaws (not shown) that clamp the open end 16 of the bag 10 and the end 14 of the venting strip 12. Vacuum is exerted by the sealer 26 to evacuate the bag 10. After air within the bag has been evacuated, the sealer 26 generates heat to heat-seal and close the open end 16 of the bag 10. For example, the sealer 26 can utilize one or more heating wires (not shown), bulbs, or other heating elements to melt the heat sealable inner layer of the bag 10. If the venting strip 12 is made of or includes heat-sealable material, the venting strip 12 preferably softens or melts to bond with the material of the bag 10 at the open end 16 thereof. Otherwise, heat sealable material of or on the bag 10 can be softened or melted sufficiently to bond to either or both sides of the venting strip 12. The resulting bond, or weld line (not shown), formed across the bag 10 preferably prevents air or other gas from entering the bag 10. Preferably, the product is then hermetically sealed.

In other embodiments, the bag 10 is sealed in other manners, such as by the use of adhesive or cohesive bonding material on the bag 10 (e.g., on the inside surfaces of the bag 10 at the open end 16 of the bag 10), by the use of pressure-bonding material on the bag 10, by the use of epoxy or other conventional bonding material that reacts to exposure to air, oxygen, light, or mixture of bonding material components, and the like. Each such method of sealing the bag 10 falls within the spirit and scope of the present invention. Accordingly, other bags 10 sealed according to the present invention can have single-layered walls or any other number of layers for the sides of the bag 10, any (or none) of which include heat-sealable material or have heat sealable material thereon.

During vacuum sealing operations, the walls of the bag 10 are drawn toward one another, which can interfere with the ability of air to be drawn from the bag 10. The shape and form of the venting strip 12 in some embodiments of the present invention help to address this problem. For example, some embodiments of the venting strip 12 have a textured or rough surface which is resistant to being sealed by a wall of the bag 10 even under pressure of the wall against the bag 10. In these and other embodiments, the venting strip 12 has a cross-sectional area that is shaped to resist being sealed in such a manner, such as a corrugated, ribbed, dimpled and/or bumpy venting strip. Further resistance to sealing can be provided by one or more apertures through the venting strip 12, such as a perforated venting strip, a mesh, or woven venting strip, and the like. Other types of venting strips provide one or more conduits through the venting strip by the use of hollow or permeable elements through which air can be drawn under vacuum from the bag 10. In short, any textured, uneven, rough, or shaped surface (whether patterned or otherwise) that is resistant to generating a seal when a plastic wall of the bag 10 is drawn into contact with the venting strip 12 can be employed for the venting strip 12. In such cases, the venting strip 12 and the wall(s) 18, 20 of the bag 10 define a plurality of passages or channels therebetween when brought into contact with one another to enable air to pass along and/or through the strip 12 from the bag 10 under vacuum.

Figure 3A:
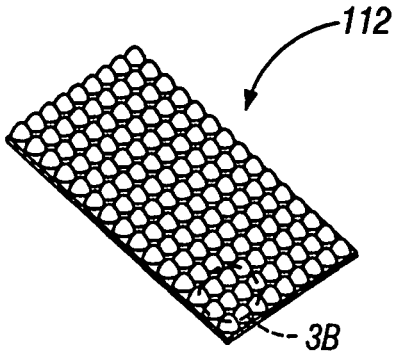
FIG. 3*a* is a perspective view of an apertured film venting strip.
Figure 3B:
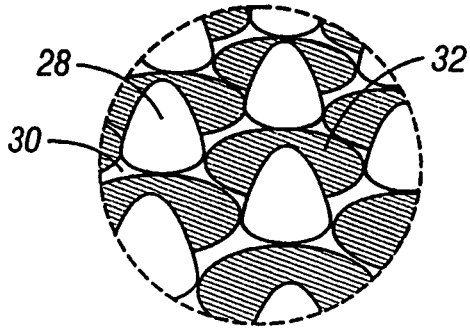
FIG. 3*b* is an enlarged partial view of the venting strip shown in FIG. 3*a;*

Several types of venting strips 12 according to the present invention are illustrated by way of example only in FIGS. 3*a*-3*f*. FIG. 3*a* illustrates a venting strip 112 in the form of an apertured film, while FIG. 3*b* illustrates an enlarged partial view of the structure associated with the apertured film. The rough texture of the film is caused by the alternating peaks 28 and valleys 30, whereby apertures 32 are located in the peaks 28 and/or valleys 30. These peaks 28 and valleys 30 act as the air passages or channels as previously described. An example of such an apertured film is "VisPore 6606," a polyethylene fabric manufactured by Tredegar Film Products, Inc. The inventors have discovered that such material provides superior seals and is resistant to leakage past the seal or weld line (not shown) once the bag 10 is vacuum sealed. Particularly when an apertured venting strip 112 such as that shown in FIGS. 1*a* and 1*b* is made partially or entirely out of thermoplastic material for heat-sealing the bag 10, the inventors have discovered that the venting strip 112 can melt and bond more reliably with the bag 10. Although other apertured venting strips 12 can be employed, bumpy and/or dimpled venting strips 112 are most preferred. Such venting strips 112 are resistant to being sealed by contact with the bag 10, but can provide excellent sealing results when heat sealed or when sealed in other manners as described above.

Figure 3C:
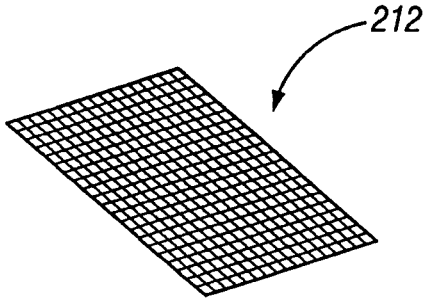
FIG. 3*c* is a perspective view of a woven or extruded mesh venting strip.
Figure 3D:
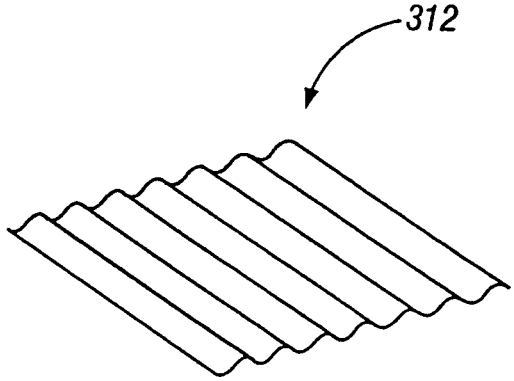
FIG. 3*d* is a perspective view of a corrugated venting strip.
Figure 3E:
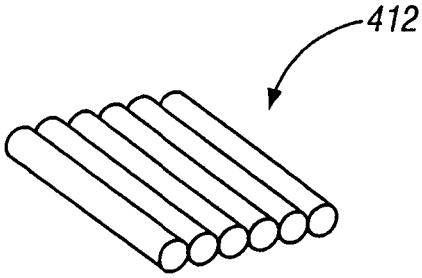
FIG. 3*e* is a perspective view of a ribbed venting strip.
Figure 3F:
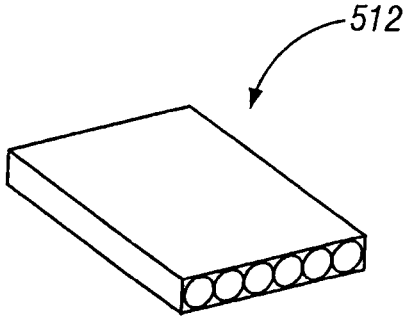
FIG. 3*f* is a perspective view of a tubular venting strip.

In some preferred embodiments, the venting strip 112 is made from apertured material (such as an apertured film or sheet as described above). Another type of apertured venting strip is illustrated in FIG. 3*c*, which illustrates venting strip 212 made of a mesh or woven material (such as a fabric, screen, or other body defining apertures therethrough) that can be made in any conventional manner, such as by weaving, extruding, and the like. Such venting strips 212 also provide air passages or channels when a wall 18, 20 of the bag 10 is drawn there against, thereby permitting air to escape when the bag 10 is under a vacuum as described above. However, non-apertured venting strips 312, 412, 512 can be employed in the present invention with excellent results. These other embodiments are shown in FIGS. 3*d*-3*f*. FIG. 3*d* illustrates a corrugated venting strip 312 that also helps to define air passages and channels running toward the open end 16 of the bag 10 under vacuum. The venting strip 312 illustrated in FIG. 3*d* can be made of any of the materials described above. FIG. 3*e* illustrates a ribbed venting strip 412 that can be manufactured in any conventional manner, such as by a series of elongated elements attached or bonded together in side-by-side relationship, by extruding a ribbed cross-sectional shape, and the like. Each such venting strip 412 preferably helps define the desired air passages and channels as described above. FIG. 3*f* illustrates yet another type of venting strip 512 that includes a plurality of tubes, conduits, or passages through the body of the venting strip 512. Air can preferably exit from the end 16 of the bag 10 through these tubes, conduits, or passages in the body of the venting strip 512.

Figure 4:
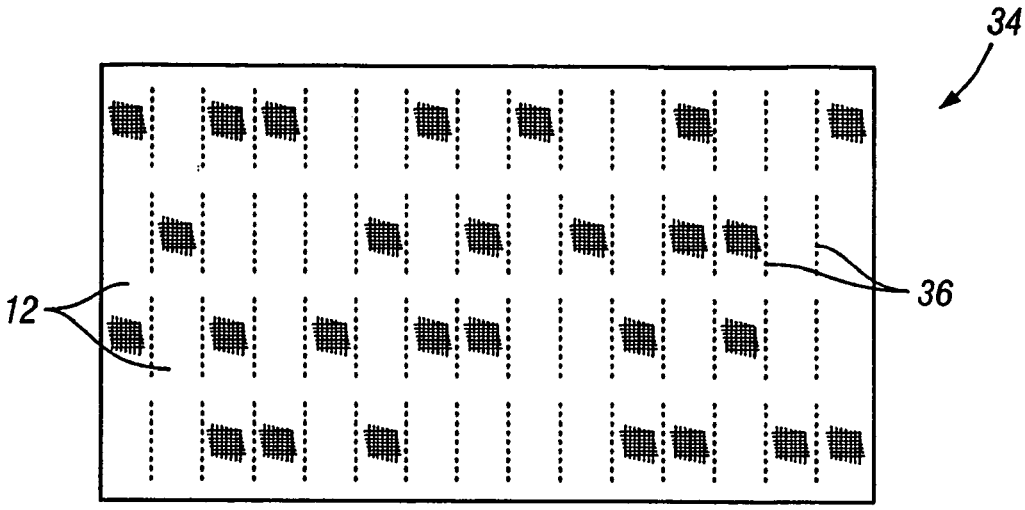
FIG. 4 is a plan view of perforated strips of venting strips.
Figure 5A:
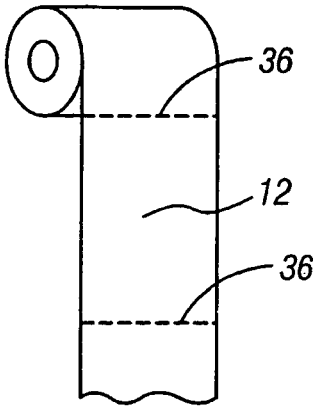
FIG. 5*a* is a perspective view of a roll of venting strip material perforated for removal by a user.
Figure 5B:
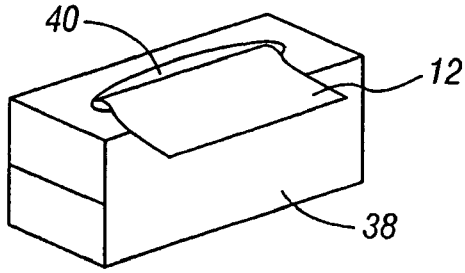
FIG. 5*b* is a perspective view of folded venting strips stored for dispense from a carton.
Figure 5C:
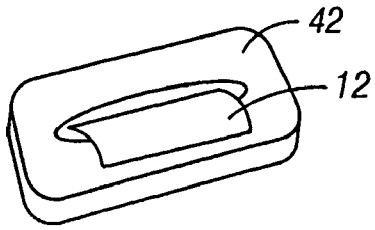
FIG. 5*c* is a perspective view of pre-cut venting strips stored for dispense from a plastic bag.

The venting strips 12 of the present invention can be produced and supplied in a number of different forms. By way of example only, venting strips can be cut or torn from a sheet of venting strip material, such as the sheet 34 of venting material illustrated in FIG. 4. In some highly preferred embodiments, perforations 36 are provided in the sheet 34 to enable a user to easily remove any number of venting strips 12 desired. Such a form of venting strips is useful when it is desired to vacuum seal a product in its original bag 10. FIGS. 5*a*-5*b* illustrate other forms in which venting strips 12 can be provided. Specifically, venting strips 12 can be provided in roll form as shown in FIG. 5*a*. Venting strips in roll form can be separated by perforations as shown, or can be cut from a roll of venting strip material in any size desired. As another example, venting strips 12 can be provided in stacked form (inter-folded or non-inter-folded) as shown in FIGS. 5*b* and 5*c*. FIG. 5*b* illustrates venting strips 12 stored within a carton 38, whereby a venting strip 12 can be pulled from the carton opening 40. FIG. 5*c* illustrates pre-cut venting strips 12 stacked and packaged in a bag 42.

Figure 6A:
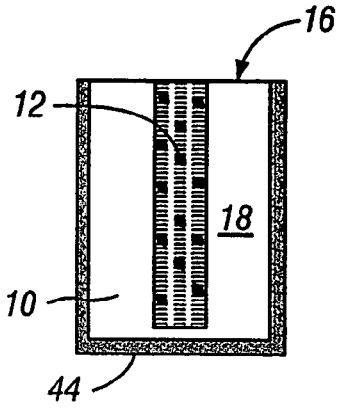
FIG. 6*a* is a plan view of a vacuum sealable bag with a vacuum strip attached to an inside wall of the bag.

With reference to FIGS. 6*a*-6*c* and FIGS. 7*a*-7*b*, several embodiments of the present invention are shown with the venting strip 12 positioned within the storage bag 10. Although the venting strip 12 can be separate from the storage bag 10 for insertion by a user into the storage bag 10 prior to vacuum sealing operations, the storage bag 10 and venting strip 12 in some embodiments are attached together and are supplied in such form to a user. For example, FIG. 6*a* illustrates a storage bag 10 and venting strip 12 assembly in which the venting strip 12 is attached to a wall 18, 20 of the storage bag 10 in any conventional manner, such as by heat staking, by any type of adhesive or cohesive bonding material, and the like. The venting strip 12 in FIG. 6*a* is preferably attached in such a manner near the open end 16 of the bag 10 (such as at points 11) in order to help maintain the position of the venting strip 12 when the storage bag 10 is loaded. However, the venting strip 12 can also or instead be attached at any other location along the length of the venting strip 12. The venting strip 12 can be attached to extend in a central location along the storage bag 10, or can be attached to either side of the center of the storage bag 10.

Figure 6B:
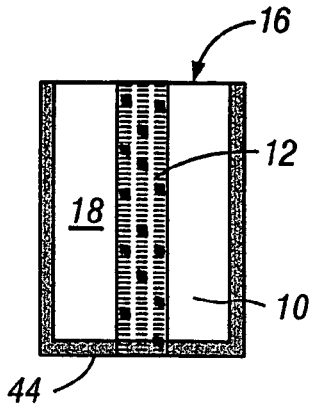
FIG. 6*b* is a plan view of a vacuum sealable bag with an attached vacuum strip positioned along the center of the bag.
Figure 6C:
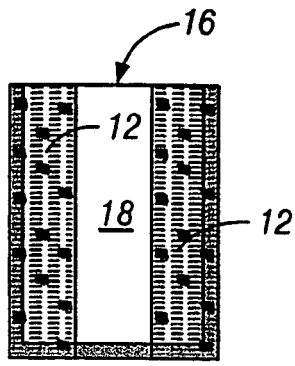
FIG. 6*c* is a plan view of a vacuum sealable bag with two attached vacuum strips positioned at the sides of the bag.

FIG. 6*b* illustrates another embodiment of the present invention in which the venting strip 12 is sealed with the bottom of the storage bag 10. In this embodiment, the venting strip 12 can also be tack welded or secured in any other manner (as described above) along any part or all of the length of the venting strip 12 such that the venting strip 12 is secured at one side of the storage bag 10. A venting strip 12 secured at the closed end 44 of the storage bag 10 helps maintain the position of the venting strip 12 in the storage bag 10 while the storage bag 10 is being loaded. FIG. 6*c* illustrates yet another embodiment of the present invention, in which two venting strips 12 are sealed with the sides and bottom of the storage bag 10. In this embodiment, the venting strips 12 can be continuously sealed along either or both side edges of the bag, while the ends of the venting strips 12 at the bottom of the storage bag 10 can be sealed with the closed end 44 of the storage bag 10. In the embodiments shown in FIGS. 6*b* and 6*c*, the venting strips 12 are preferably secured within the storage bag 10 by being sealed between panels 18, 20 of the storage bag 10 along the side edges and/or bottom edge of the panels 18, 20 of the storage bag 10. This attachment can be in any form, and in some highly preferred embodiments is via heat sealing of the bag edges during manufacture of the storage bag 10.

Figure 7A:
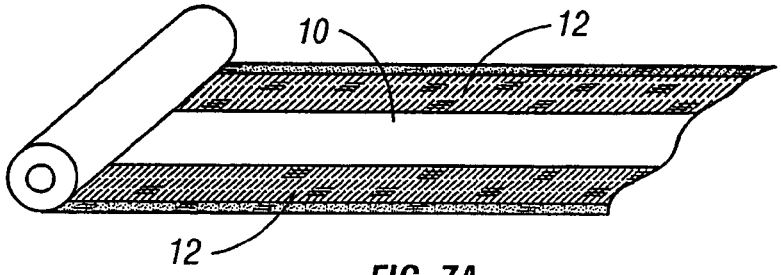
FIG. 7*a* is a perspective view of a continuous roll of tube stock with venting strips as shown in FIG. 6*c;*
Figure 7B:
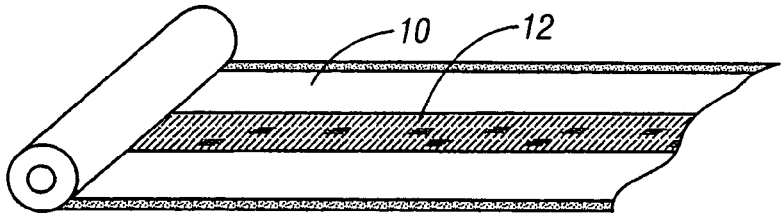
FIG. 7*b* is a perspective view of a continuous roll of tube stock with venting strips as shown in FIG. 6*b;*

The storage bags 10 are preferably manufactured in fixed volume sizes, but can also be manufactured in the form of tube stock as shown in FIGS. 7*a*-7*b*. FIG. 7*a* illustrates one embodiment of a continuous length of tube stock with a continuous length of venting strip material sealed with the sides of the tube stock. FIG. 7*b* illustrates another embodiment of a continuous length of tube stock with a continuous length of venting strip attached near the center of the storage bag 10 at various points or continuously along the venting strip 12 as described in greater detail above. In both embodiments of the tube stock shown in FIGS. 7*a* and 7*b*, the tube stock is cut to a specified length, and one end of the length is sealed to form a storage bag 10. In other embodiments however, the tube stock can be perforated to enable a user to easily remove a portion of the tube stock which can be sealed at an end to form the storage bag 10. Once these steps are taken, a storage bag 10 made from the tube stock illustrated in FIG. 7*a* can resemble that shown in FIG. 6*c*, while a storage bag 10 made from the tube stock illustrated in FIG. 7*b* can resemble that shown in FIG. 6*b*.

Figure 8:
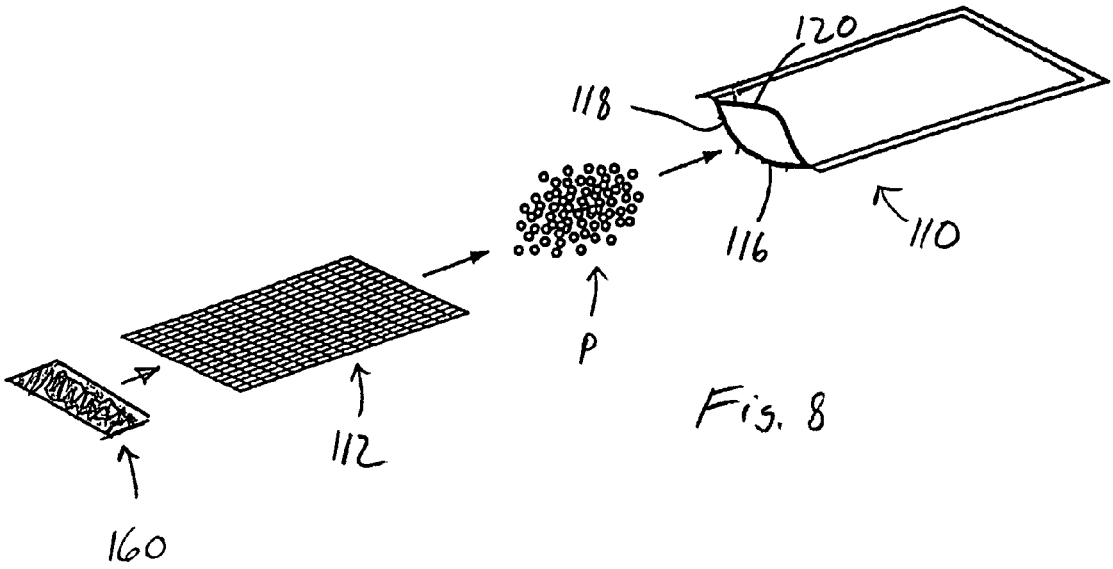
FIG. 8 is a front perspective view of another vacuum sealable bag with an insertable venting strip and an insertable filter strip or absorbent pad.
Figure 9:
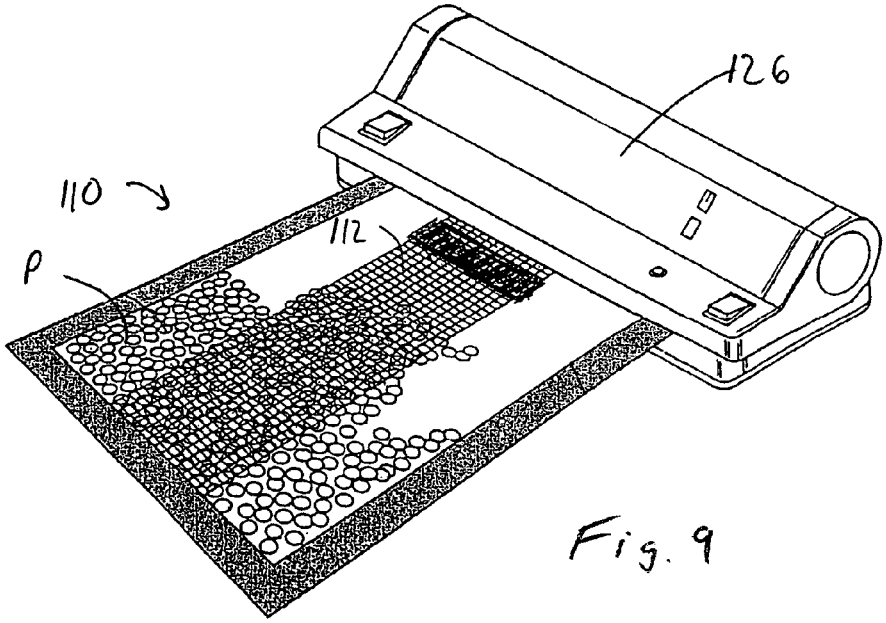
FIG. 9 is a front perspective view of a conventional vacuum sealing apparatus, shown with the vacuum sealable bag illustrated in FIG. 8.
Figure 10:
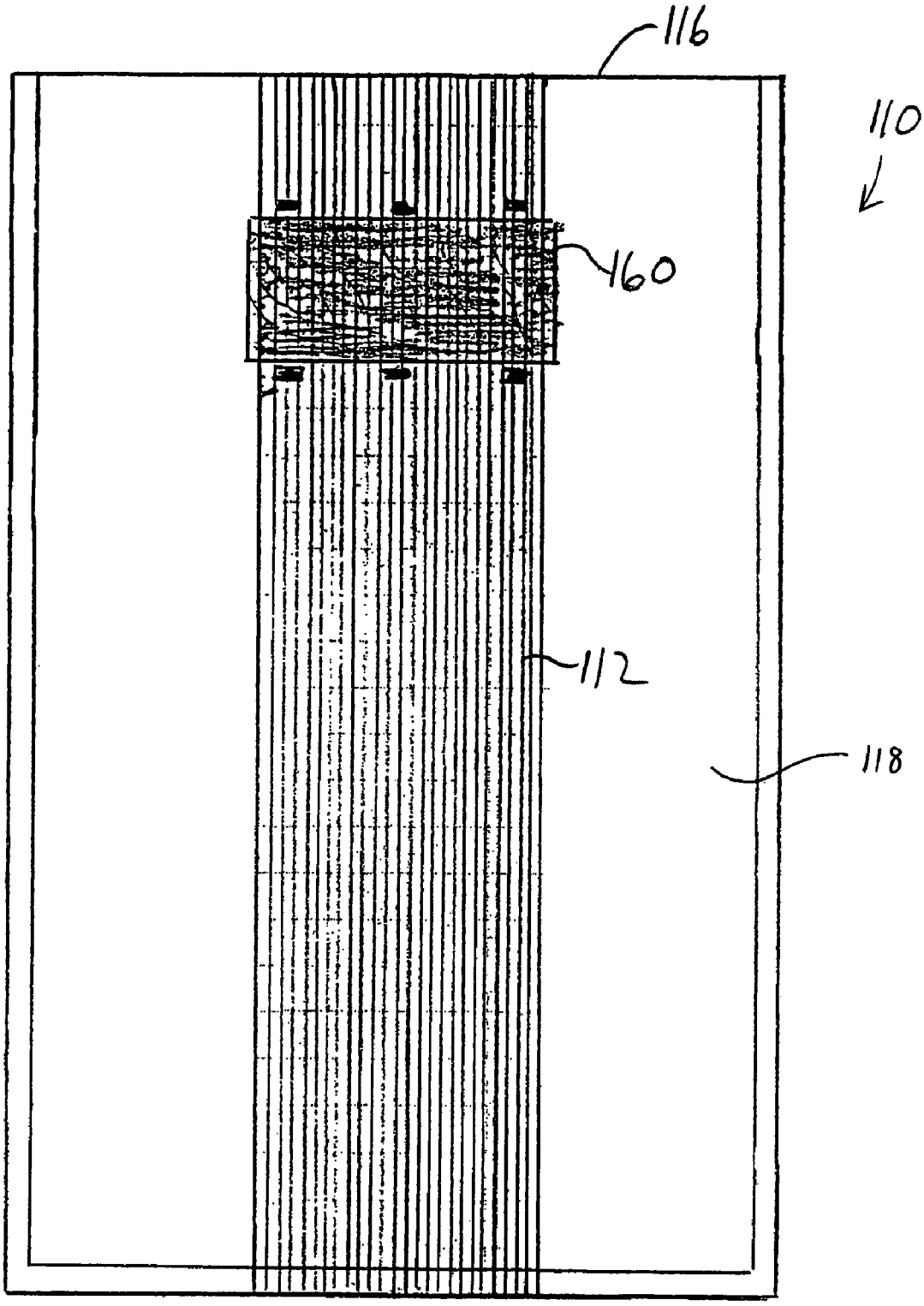
FIG. 10 is a top perspective view of the vacuum sealable bag of FIG. 8.

FIGS. 8-10 illustrate another embodiment of the present invention similar in many respects to the embodiments of the present invention illustrated in FIGS. 1-7*b* described above. With the exception of mutually inconsistent features and elements between the embodiments of FIGS. 1-7*b* and the embodiment of FIGS. 8-10, reference is hereby made to the description accompanying the embodiments of FIGS. 1-7*b* for further description of the features and elements (and alternatives thereto) of FIGS. 8-10. Features and element illustrated in FIGS. 8-10 corresponding to those illustrated in FIGS. 1-7*b* are provided with like reference numbers in the 100 series.

FIG. 8 illustrates a vacuum sealable bag 110, along with product P to be stored and sealed in the bag 110, a venting strip 112 according to any of the embodiments described above (installed in any of the manners also described above), and a pad 60 as will be described in greater detail below. Although the embodiment of the present invention illustrated in FIGS. 8-10 employs a venting strip 112 in combination with a pad 160, in other embodiments, the pad 160 can be employed without a venting strip. In such cases, the pad 160 can still perform one or more of the pad functions described below in conjunction with any type of vacuum sealable bag. By way of example only, the pad 160 can be employed with vacuum sealable bags having one or more embossed portions used in venting such bags, vacuum sealable bags having one or more portions that are shaped (e.g., ribbed, corrugated, dimpled, and the like) in any other manner to enhance venting, and any other type of bag that can be vacuum sealed.

With reference again to the embodiment of the present invention illustrated in FIGS. 8-10, the pad 160, like the venting strip 112, can be inserted between the walls 118, 120 of the bag 110. In some embodiments (such as that shown in FIGS. 8-10), the pad 160 can be positioned between the stored product P and the portion of the bag 110 to be sealed before the bag 110 is evacuated.

Sometimes, during evacuation of the air in the bag 110, portions of the stored product P (e.g., solid particles or fluid) are drawn to the open end 116 of the bag 110. The presence of portions of the stored product P in the vicinity of the open end 116 can result in a contaminated seal between the walls 118, 120, or can otherwise adversely impact the ability of the bag 110 to be properly or fully sealed. As a result, the open end 116 of the bag 110 may not be fully sealed (e.g., across the entire width of the open end 116).

As shown in FIG. 10, the pad 160 can be positioned to at least partially prevent the product P from interfering with a seal to be made at the open end 116 of the bag 110. In some embodiments, the pad 160 is spaced from the open end 116 of the bag 110, such that particulate or fluid portions of the stored product P are at least partially blocked, trapped, and/or absorbed by the pad 160 before reaching the portion of the bag 110 to be sealed. As a result, a more complete seal between the walls 118, 120 can be achieved. To this end, the pad 160 can be located anywhere in the bag 110 in which the pad 160 blocks, traps, and/or absorbs product P that would otherwise approach the open end 116 of the bag 110. In the illustrated exemplary embodiment of FIGS. 8-10 (and in other embodiments), the pad 160 is positioned between the product P and the open end 116 of the bag 110 for this purpose.

In the illustrated exemplary embodiment of FIGS. 8-10, the pad 160 is shown substantially laterally extending across the width of the bag 110, between opposite sides of the bag 110. More particularly, the pad 160 is sized to only extend across the width of the venting strip 112 or a portion thereof (as opposed to the entire width of the open end 116 of the bag 110). Such an arrangement can be employed in those cases in which the majority of the particulate or fluid portions of the stored product P accompanying the air drawn from the interior of the bag 110 are pulled through the channels defined between the walls 118, 120 and the venting strip 112. However, the pad 160 can instead be configured to extend across other portions of the bag 110 not occupied by the venting strip 112. As discussed above, the venting strip 112 can be located in a number of other positions in the bag 110, such as at a side edge of the bag 110 or in any other desired location. In such cases, the pad 160 can still be located to extend across any portion or all of the venting strip 112, and/or can extend across other portions of the bag 110. In some embodiments, the venting strip 112 extends across the width (or substantially the entire width) of the bag 110.

The embodiment illustrated in FIGS. 8-10 employs a single pad 160. However, it should be noted that any number of pads 160 can be employed in other embodiments, and can be located in any number of different locations in the bag 110. By way of example only, two or more pads 160 can extend across at least part of the venting strip 112 at different locations. As another example, two or more pads 160 can be located on respective venting strips 112 (in cases where the bag 110 has two or more venting strips 112). As yet another example, a bag 110 can have one or more pads 160 extending across at least a portion of a venting strip 112 and one or more other pads 160 extending across one or more other portions of the bag 110 disposed from the venting strip 112. Any number of pads 160 and any combination of locations for the pads 160 can be employed as desired.

The pad 160 can be made from a number of different materials. By way of example only, the pad 160 can be made of paper materials, fabric materials, plastic or other synthetic materials, cork, and the like. The pad 160 can also be made of any combination of such materials. In addition, the pad 160 can take a number of different forms. By way of example only, the pad material can be woven, non-woven, mesh, pile, open or closed-cell foam, fibrous, solid, and the like. The pad 160 can be constructed of material that absorbs fluid, thereby absorbing fluid from the product P during the bag sealing process and helping to prevent such fluid from interfering with sealing of the bag. In other embodiments, a non-absorbent pad 160 can be employed as a blocking or damming element to prevent or obstruct movement of product P toward the open end 116 of the bag 110. Pads 160 made of absorbent material can also perform such functions.

In some embodiments, the pad 160 is made from a food-grade, heat-sealable material, in which case the pad 160 can be attached to one or more walls 118, 120 of the bag 110 by any type of heat sealing or bonding. In those embodiments in which a wall 118, 120 of the bag 110 includes heat-sealable material, the pad 160 can be attached to the wall 118, 120 in the same manner. The pad 160 can be unattached to the bag 110 in some embodiments. In such cases, the pad 160 can be inserted and positioned within the bag 110 after the product P is placed within the bag 110. However, securing the pad 160 to a wall 118, 120 of the bag 110 (e.g., in a location near the open end 116 of the bag 110) can provide better control over the position of the pad 160 during vacuum sealing operations. Also, depending at least in part upon the manner in which the pad 160 is attached within the bag 110, some embodiments of the present invention still enable the pad 160 to be inserted within the bag 110 after insertion of the product P therein (e.g., where the pad 160 is attached to a venting strip 112 that can be extended outside of the bag 110 prior to inserting the product P, and then re-inserted into the bag 110 after the product P has been inserted).

As an alternative to heat sealing or heat bonding (e.g., tacking, staking, and the like), the adsorbent pad 160 can be secured to a wall 118, 120 of the bag 110 and/or to a venting strip 112 in the bag 112 in any of the manners described above with reference to the earlier embodiments (e.g., by adhesive or cohesive bonding material, or in any other suitable manner). The pad 160 can be secured within the bag 110 by being attached to either or both walls 118, 120 of the bag 110 and/or by being attached to the venting strip(s) 112 in any of the attachment manners described above. Alternatively or in addition, the pad 160 can be trapped between a venting strip 112 and a wall 118, 120 of the bag 110, and/or between heat stakes in the bag 110, in which case the pad 160 need not necessarily be directly attached to the bag 110 as described above.

As also discussed above, the pad 160 can be attached to the bag 110 in a number of different manners and in a number of different positions. By way of example only, the pad 160 illustrated in FIG. 10 is located between the venting strip 112 and a wall 118 of the bag 110 to which the venting strip 112 is heat staked. A plurality of heat stakes trap the pad 160 in place between the venting strip 112 and the wall 118 of the bag 110. If desired, the venting strip 112 can be also secured within the bag 110 in any of the manners described above (e.g., to the side edges or bottom edge of the walls 118, 120). In another exemplary embodiment, the venting strip 12 can be heat staked to one of the walls 118, 120 (similar to the embodiment shown in FIG. 6*a*) along any portion or all of the length of the venting strip 112. In such a case, the pad 160 can be heat staked to the venting strip 112 such that the pad 160 substantially laterally extends across the width of the venting strip 112. Similar configurations are possible in those embodiments in which the venting strip 112 is located and secured at a side edge of the bag 110.

Pads 160 can be attached to bag tube stock, such as the tube stock illustrated in FIGS. 7*a* and 7*b*, in which case such pads 160 can be secured at intervals along the length of the tube stock. Alternatively, pads 160 can be attached to bags 110 made from tube stock during or after such bags 110 are formed from the tube stock as described above.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

I claim:

1. A vacuum sealable storage bag assembly, comprising:

a plastic bag comprising a first panel defining opposite side edges and opposite end edges;

a second panel defining opposite side edges and opposite end edges, the opposite side edges of the second panel coupled to the respective opposite side edges of the first panel, one of the opposite end edges of the second panel coupled to an adjacent end edge of the first panel, wherein a bag opening is defined at another of the opposite end edges of the second panel; and a pad of fluid-absorbing material positioned within the plastic bag adjacent the bag opening, the pad of fluid-absorbing material located a distance from the opposite end edges of the first and second panels defining the bag opening, wherein the pad of fluid-absorbing material is also located between a product-holding portion of the bag and the bag opening to absorb fluid drawn toward the bag opening during vacuum sealing operations, and wherein the pad of fluid-absorbing material is coupled to at least one of the first and second panels.

2. The vacuum sealable storage bag assembly as claimed in claim 1, further comprising a strip of material located at least partially within the plastic bag and extending toward an exterior area of the plastic bag, the strip of material establishing fluid communication between an interior of the plastic bag and the exterior of the plastic bag, wherein the strip of material is shaped to resist fluid-tight closure of the first panel against the second panel by establishment of fluid passages between the strip of material and at least one of the first and second panels.

3. The vacuum sealable storage bag assembly as claimed in claim 2, wherein the pad of fluid-absorbing material is coupled to at least one of the first and second panels via the strip of material.

4. The vacuum sealable storage bag assembly as claimed in claim 1, wherein the pad of fluid-absorbing material comprises heat-sealable material.

5. The vacuum sealable storage bag assembly as claimed in claim 1, wherein the pad of fluid-absorbing material is elongated in shape and extends in a substantially lateral direction between the opposite side edges of the first and second panels.

6. The vacuum sealable storage bag assembly as claimed in claim 2, wherein the pad of fluid-absorbing material extends substantially entirely across the strip of material adjacent the bag opening.

7. The vacuum sealable storage bag assembly as claimed in claim 2, wherein the strip of material has an textured exterior surface.

8. A vacuum-sealable storage bag assembly, comprising:

a plastic bag comprising a first panel defining opposite side edges and opposite end edges;

a second panel defining opposite side edges and opposite end edges, the opposite side edges of the second panel coupled to the respective opposite side edges of the first panel, one of the opposite end edges of the second panel coupled to an adjacent end edges of the first panel, wherein a bag opening is defined at another of the opposite end edges of the second panel;

a pad of fluid-absorbing material positioned within the plastic bag adjacent the bag opening, the pad of fluid-absorbing material located between a product-holding portion of the bag and the bag opening to absorb fluid drawn toward the bag opening during vacuum sealing operations, wherein the pad of fluid-absorbing material is coupled to at least one of the first and second panels; and a textured strip of material located at least partially within the plastic bag and extending toward an exterior area of the plastic bag, the strip of material establishing fluid communication between an interior of the plastic bag and the exterior of the plastic bag, wherein the strip of material is shaped to resist fluid-tight closure of the first panel against the second panel by establishment of fluid passages between the strip of material and at least one of the first and second panels.

9. The vacuum sealable storage bag assembly as claimed in claim 8, wherein the pad of fluid-absorbing material is coupled to at least one of the first and second panels via the strip of material.

10. The vacuum sealable storage bag assembly as claimed in claim 8, wherein the pad of fluid-absorbing material comprises heat-sealable material.

11. The vacuum sealable storage bag assembly as claimed in claim 8, wherein the pad of fluid-absorbing material is elongated in shape and extends in a substantially lateral direction between the opposite side edges of the first and second panels.

12. The vacuum sealable storage bag assembly as claimed in claim 8, wherein the pad of fluid-absorbing material extends substantially entirely across the strip of material adjacent the bag opening.

13. The vacuum sealable storage bag assembly as claimed in claim 8, wherein the pad of fluid-absorbing material is located within the interior of the bag a distance from the bag opening.

14. A vacuum sealable storage bag assembly, comprising:

a plastic bag having an interior and an exterior, the interior and exterior of the plastic bag in fluid communication with one another only through a mouth of the plastic bag;

a strip of material extending from the interior toward the mouth of the plastic bag, the strip of material having an exterior surface and establishing fluid communication between the interior of the plastic bag and the exterior of the plastic bag, wherein the exterior surface of the strip of material is shaped to resist fluid-tight closure of the mouth by establishment of fluid passages between the strip of material and the plastic bag; and a pad of fluid-absorbing material positioned within and coupled to the plastic bag adjacent the mouth of the plastic bag, the pad of fluid-absorbing material located between a product-holding portion of the plastic bag and the mouth of the plastic bag to absorb fluid drawn toward the mouth of the plastic bag during vacuum sealing operations.

15. The vacuum sealable storage bag assembly as claimed in claim 14, wherein the pad of fluid-absorbing material is coupled to the plastic bag via the strip of material.

16. The vacuum sealable storage bag assembly as claimed in claim 14, wherein the pad of fluid-absorbing material comprises heat-sealable material.

17. The vacuum sealable storage bag assembly as claimed in claim 14, wherein the pad of fluid-absorbing material is elongated in shape and extends in a substantially lateral direction between opposite side edges of the plastic bag.

18. The vacuum sealable storage bag assembly as claimed in claim 14, wherein the pad of fluid-absorbing material extends substantially entirely across the strip of material adjacent the mouth of the plastic bag.

19. The vacuum sealable storage bag assembly as claimed in claim 14, wherein the pad of fluid-absorbing material is located within the interior of the plastic bag a distance from the mouth of the plastic bag.

20. The vacuum sealable storage bag assembly as claimed in claim 14, wherein the pad of fluid-absorbing material is secured to an interior surface of the plastic bag.

* * * * *

US007270238C1

(12) EX PARTE REEXAMINATION CERTIFICATE (10625th)

United States Patent
Shannon

(10) Number: US 7,270,238 C1
(45) Certificate Issued: Jun. 9, 2015

(54) VACUUM SEALABLE BAG APPARATUS AND METHOD

(75) Inventor: Daniel P. Shannon, Green Bay, WI (US)

(73) Assignee: FOODFRESH TECHNOLOGIES LLC, Wausau, WI (US)

Reexamination Request:
No. 90/013,013, Oct. 3, 2013

Reexamination Certificate for:

| | |
|---|---|
| Patent No.: | **7,270,238** |
| Issued: | **Sep. 18, 2007** |
| Appl. No.: | **10/782,536** |
| Filed: | **Feb. 19, 2004** |

Related U.S. Application Data

(63) Continuation-in-part of application No. 10/124,589, filed on Apr. 17, 2002, now Pat. No. 6,991,109.

(60) Provisional application No. 60/284,690, filed on Apr. 17, 2001, provisional application No. 60/448,244, filed on Feb. 19, 2003.

(51) Int. Cl.
*B65B 31/04* (2006.01)

(52) U.S. Cl.
CPC ..... *B65B 31/04* (2013.01)

(58) Field of Classification Search
USPC ..... 206/524.8, 484; 383/94, 117
See application file for complete search history.

(56) References Cited

To view the complete listing of prior art documents cited during the proceeding for Reexamination Control Number 90/013,013, please refer to the USPTO's public Patent Application Information Retrieval (PAIR) system under the Display References tab.

*Primary Examiner* — Matthew C Graham

(57) ABSTRACT

Some embodiments of the present invention provide a vacuum sealable storage bag and method in which a pad of material is located within the storage bag and is positioned to block, trap, and/or absorb fluid from product to be stored within the storage bag. The pad of material can comprise fluid-absorbing material, and in some embodiments is positioned between an open mouth of the bag and an interior of the bag in which product is retained.

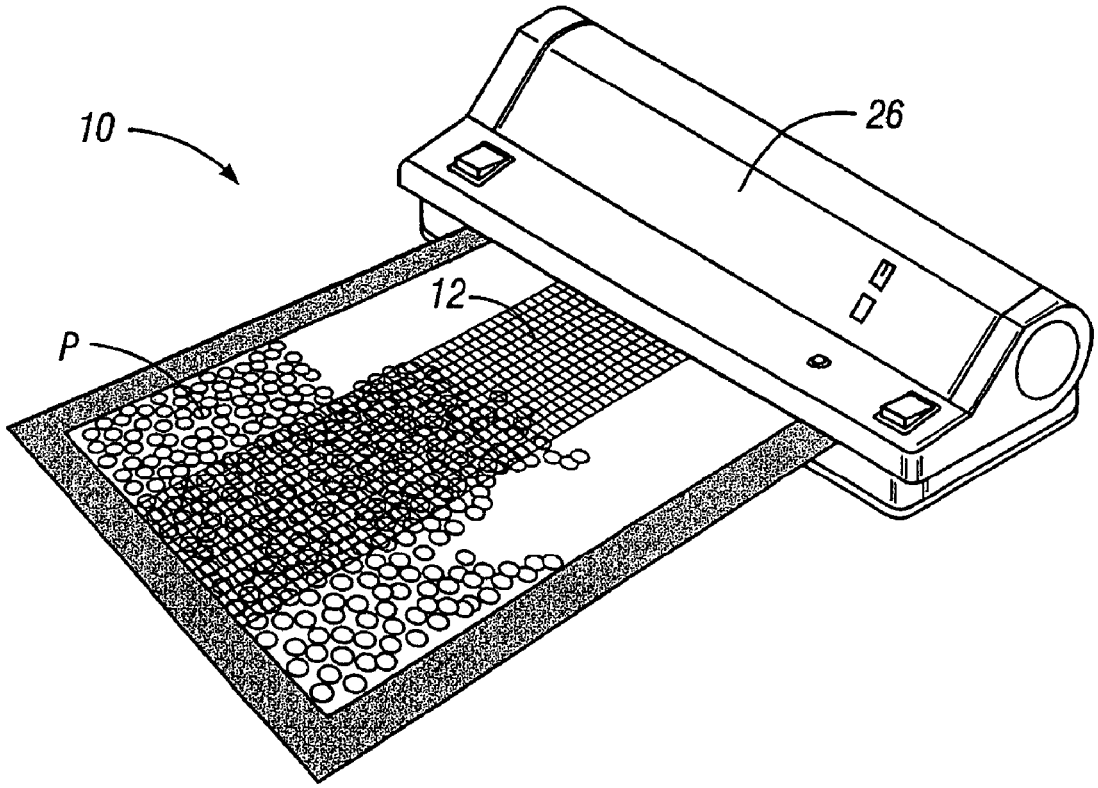

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-20 are cancelled.

* * * * *